US011085662B2

(12) United States Patent
Koizumi et al.

(10) Patent No.: US 11,085,662 B2
(45) Date of Patent: Aug. 10, 2021

(54) AIR-CONDITIONING SYSTEM

(71) Applicant: Mitsubishi Electric Corporation, Tokyo (JP)

(72) Inventors: Yoshiaki Koizumi, Tokyo (JP); Masafumi Tomita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/349,647

(22) PCT Filed: Jan. 30, 2017

(86) PCT No.: PCT/JP2017/003141

§ 371 (c)(1),
(2) Date: May 14, 2019

(87) PCT Pub. No.: WO2018/138903

PCT Pub. Date: Aug. 2, 2018

(65) Prior Publication Data

US 2019/0346166 A1 Nov. 14, 2019

Related U.S. Application Data

(63) Continuation of application No. PCT/JP2017/003141, filed on Jan. 30, 2017.

(51) Int. Cl.
*F24F 11/38* (2018.01)
*F24F 11/64* (2018.01)
(Continued)

(52) U.S. Cl.
CPC ..... *F24F 11/38* (2018.01); *F24F 11/52* (2018.01); *F24F 11/56* (2018.01); *F24F 11/64* (2018.01); *F24F 2140/00* (2018.01)

(58) Field of Classification Search
CPC .. F24F 11/30; F24F 11/56; F24F 11/58; F24F 11/54; F24F 11/32; G05B 15/02; G05B 2219/2614; G05B 2219/24048
See application file for complete search history.

(56) References Cited

U.S. PATENT DOCUMENTS 7,770,403 B2 * 8/2010 Kojima ..... F24F 1/0003 62/132
2003/0140637 A1 * 7/2003 Masui ..... F24F 11/30 62/127
(Continued)

FOREIGN PATENT DOCUMENTS

CN 102840646 B 10/2014
EP 2264374 A1 12/2010
(Continued)

OTHER PUBLICATIONS

International Search Report of the International Searching Authority dated Apr. 4, 2017 for the corresponding International application No. PCT/JP2017/003141 (and English translation).
(Continued)

*Primary Examiner* — Darrin D Dunn
(74) *Attorney, Agent, or Firm* — Posz Law Group, PLC

(57) ABSTRACT

An air-conditioning system includes an air-conditioning apparatus including an outdoor unit storing outdoor-unit identification information an indoor unit storing indoor-unit identification information, and a remote controller including a third memory configured to store the outdoor-unit identification information and the indoor-unit identification information and a display unit configured to display error information when an abnormal condition occurs in the air-conditioning apparatus. The remote controller is configured to obtain the outdoor-unit identification information from the outdoor unit and to obtain the indoor-unit identification information from the indoor unit. The remote controller is
(Continued)

configured to store the obtained outdoor-unit identification information and indoor-unit identification information into the third memory. The remote controller is configured to cause the display unit to display the stored outdoor-unit identification information and indoor-unit identification information together with the error information when an abnormal condition occurs in the air-conditioning apparatus.

6 Claims, 4 Drawing Sheets

(51) Int. Cl.
*F24F 11/56* (2018.01)
*F24F 11/52* (2018.01)
*F24F 140/00* (2018.01)

(56) References Cited

U.S. PATENT DOCUMENTS

2005/0131991 A1* 6/2005 Ogawa ..... H04L 12/2803 709/201
2006/0026972 A1* 2/2006 Masui ..... F24F 11/30 62/127
2010/0325270 A1* 12/2010 Ishizaka ..... F24F 11/62 709/224
2011/0119454 A1* 5/2011 Kung ..... G06F 3/14 711/150
2011/0218682 A1* 9/2011 Cha ..... F24F 11/30 700/276
2012/0318010 A1 12/2012 Matsumoto et al.
2013/0261805 A1* 10/2013 Kuroiwa ..... G05D 23/00 700/276
2015/0112462 A1* 4/2015 Kuroiwa ..... G05B 15/02 700/90
2015/0204562 A1 7/2015 Matsumoto et al.
2016/0246269 A1 8/2016 Ahmed
2017/0010014 A1* 1/2017 Miyata ..... G05B 15/02

FOREIGN PATENT DOCUMENTS

EP 3018424 A1 5/2016
JP 2000-242401 A 9/2000
JP 2001-012736 A 1/2001
JP 2013-002725 A 1/2013
JP 2013-029302 A 2/2013
JP 2015-224858 A 12/2015
JP 2016-080273 A 5/2016
WO WO-2016162952 A1 * 10/2016 ..... F24F 11/62

OTHER PUBLICATIONS

Office Action dated Jan. 28, 2020 for the corresponding AU application No. 2017395923.
Indian Examination Report dated Mar. 23, 2021, issued in corresponding Indian Patent Application No. 201947027275 (and English Machine Translation).

* cited by examiner

AIR-CONDITIONING SYSTEM

CROSS REFERENCE TO RELATED APPLICATION

This application is a U.S. national stage application of PCT/JP2017/003141 filed on Jan. 30, 2017, the contents of which are incorporated herein by reference.

TECHNICAL FIELD

The present invention relates to an air-conditioning system in which data is exchanged between devices.

BACKGROUND ART

Typical air-conditioning apparatuses include remote controllers (hereinafter, appropriately referred to as "remote controls"). A remote control provides notification of details of an abnormal condition and an emergency contact when the abnormal condition occurs in an air-conditioning apparatus. The emergency contact can be rewritten. For example, Patent Literature 1 discloses an apparatus that provides notification of details of an abnormal condition and an emergency contact stored in a contact storage unit when the abnormal condition is detected by an abnormal condition detection unit.

This apparatus includes a remote control, with which the apparatus is operated. The remote control can be operated to rewrite a contact. As the emergency contact is rewritten by operating the remote control, it is easy to rewrite the contact without using, for example, a dedicated rewriting tool. Furthermore, the apparatus allows the emergency contact, which is to be provided when an abnormal condition occurs, to be rewritten not only by operating the remote control but also by using a copy of a contact received by the remote control from another device through a communication link or an input from a personal computer (PC) connected to the apparatus.

CITATION LIST

Patent Literature

Patent Literature 1: Japanese Unexamined Patent Application Publication No. 2001-12736

SUMMARY OF INVENTION

Technical Problem

In the apparatus disclosed in Patent Literature 1, the remote control displays, for example, a maintenance-operator's contact, upon occurrence of an abnormal condition. For example, if the type of the apparatus in which the abnormal condition has occurred is unknown, a maintenance operator needs to visit a installation location in which the apparatus is installed, determine the type of the apparatus, and then prepare, for example, repair parts. Disadvantageously, after the occurrence of the abnormal condition, much time is required to remove the abnormal condition.

The present invention has been made in view of the above-described disadvantages, and aims to provide an air-conditioning system that enables identification information about an apparatus to be determined when an abnormal condition occurs in the apparatus.

Solution to Problem

An air-conditioning system according to an embodiment of the present invention includes an air-conditioning apparatus including an outdoor unit, an indoor unit, and a remote controller connected to the indoor unit. The outdoor unit and the indoor unit include devices and pipes included in a refrigerant circuit. The outdoor unit includes a first memory storing outdoor-unit identification information including a product model name and a serial number of the outdoor unit. The indoor unit includes a second memory storing indoor-unit identification information including a product model name and a serial number of the indoor unit. The remote controller includes a third memory configured to store the outdoor-unit identification information and the indoor-unit identification information and a display unit configured to display error information representing details of an abnormal condition when the abnormal condition occurs in the air-conditioning apparatus. The remote controller is configured to obtain the outdoor-unit identification information from the outdoor unit and to obtain the indoor-unit identification information from the indoor unit. The remote controller is configured to store the obtained outdoor-unit identification information and indoor-unit identification information into the third memory. The remote controller is configured to cause the display unit to display the stored outdoor-unit identification information and indoor-unit identification information together with the error information when an abnormal condition occurs in the air-conditioning apparatus.

Advantageous Effects of Invention

According to an embodiment of the present invention, as described above, the identification information stored in the outdoor unit and the identification information stored in the indoor unit are stored in the remote controller. Consequently, when an abnormal condition occurs in the apparatus, the pieces of identification information about the apparatus can be determined.

DESCRIPTION OF EMBODIMENTS

Embodiment 1

An air-conditioning system according to Embodiment 1 will be described below.

[Configuration of Air-Conditioning Apparatus]

Figure 1:
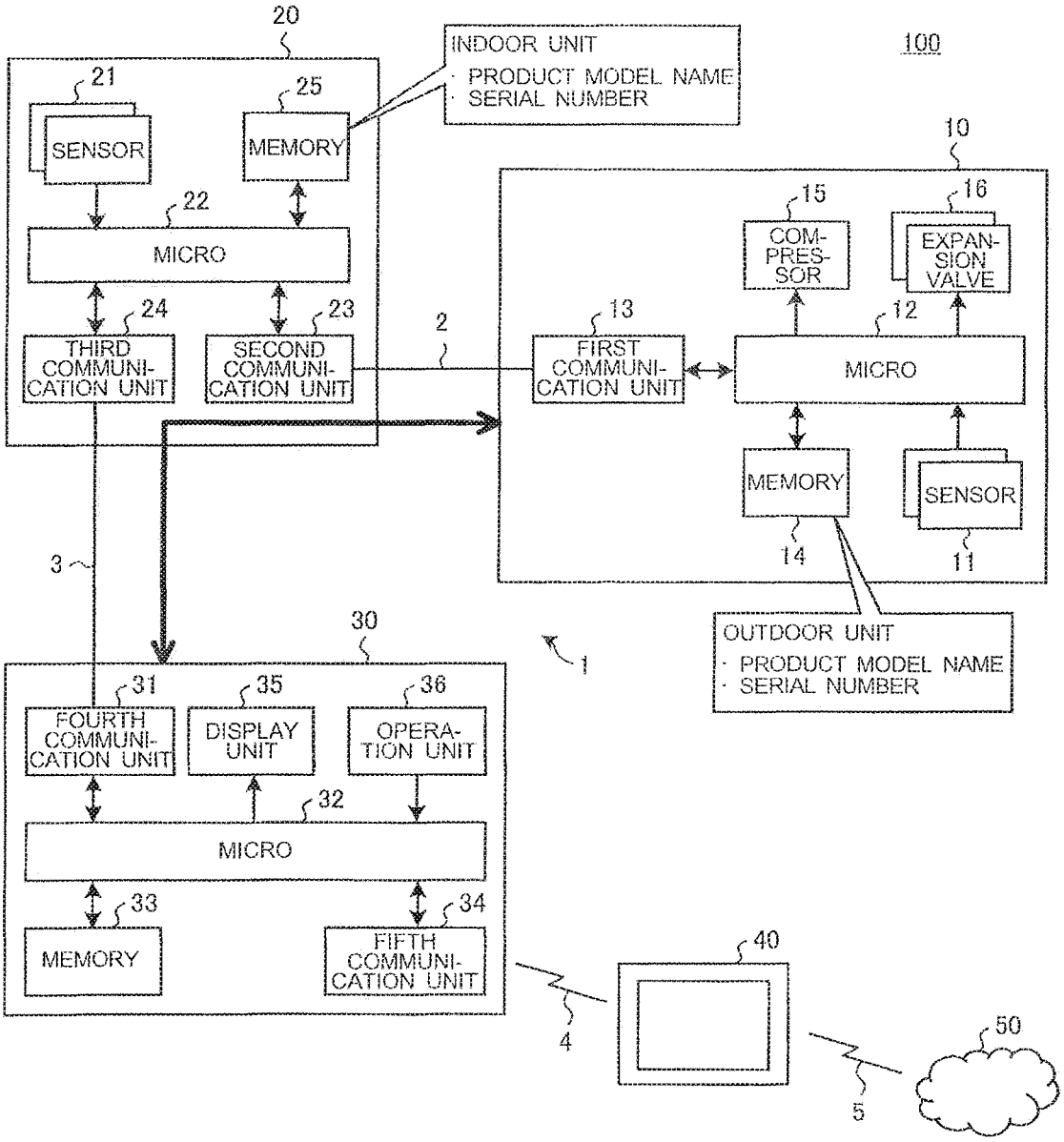
FIG. 1 is a block diagram illustrating an exemplary configuration of an air-conditioning system according to Embodiment 1.

FIG. 1 is a block diagram illustrating an exemplary configuration of an air-conditioning system 100 according to Embodiment 1. As illustrated in FIG. 1, the air-conditioning system 100 includes an air-conditioning apparatus 1 including an outdoor unit 10, an indoor unit 20, and a remote control 30, and further includes an information terminal 40.

In the air-conditioning apparatus 1, the outdoor unit 10 and the indoor unit 20 are connected with a first connection line 2, which is wired or wireless, by using a first communication mode. The indoor unit 20 and the remote control 30 are connected with a second connection line 3, which is wired or wireless, by using a second communication mode.

The remote control 30 is connected to the information terminal 40 with a third connection line 4, which is wireless, by using a third communication mode. Examples of the third communication mode include short-range wireless communication based on Bluetooth (registered trademark) low energy (BLE) technology. The remote control 30 can be connected not only to the information terminal 40 but also to general-purpose devices (not illustrated), such as temperature and humidity sensors, arranged in, for example, an air-conditioned space, by using the third communication mode.

The information terminal 40 is capable of providing information about the air-conditioning apparatus 1, for example, controlled states of components of the air-conditioning apparatus 1, to a user. The information terminal 40 is further capable of giving, for example, an instruction for trial operation, to the air-conditioning apparatus 1. Examples of the information terminal 40 include a smartphone, a tablet terminal, and a mobile terminal, such as a notebook PC. The information terminal 40 may be any other terminal. A stationary terminal, such as a desktop PC, may be used.

(Air-Conditioning Apparatus)

The configuration of the air-conditioning apparatus 1 will be described below. The air-conditioning apparatus 1 includes a compressor, a heat source-side heat exchanger, an expansion valve, and a use-side heat exchanger. These components are connected by pipes and refrigerant flows through the components, thereby forming a refrigerant circuit. In the exemplary configuration of FIG. 1, only the components associated with features of Embodiment 1 are illustrated. The detailed description of devices included in the refrigerant circuit is omitted herein.

(Outdoor Unit)

The outdoor unit 10 of the air-conditioning apparatus 1 includes one or more sensors 11, a microcomputer (hereinafter, appropriately referred to as a "micro") 12, a first communication unit 13, a memory 14, a compressor 15, and an expansion valve 16. The compressor 15 and the expansion valve 16 are the devices included in the refrigerant circuit.

The sensors 11 are arranged at different positions in and on the outdoor unit 10 to determine states of targets. Specifically, the sensors 11 are, for example, temperature sensors to determine temperatures at the positions, for example, an outdoor air temperature, a temperature of the compressor 15, and temperatures of the pipes. Information representing the determined temperatures at the positions in and on the outdoor unit 10 is provided as outdoor-unit sensor information to the micro 12. The sensors 11 are not limited to temperature sensors. For example, pressure sensors may be used to determine pressures at the positions.

The micro 12 controls the whole of the outdoor unit 10, for example, controls operations of the devices, such as the compressor 15 and the expansion valve 16, included in the refrigerant circuit. For example, the micro 12 gives a compressor-frequency instruction for the compressor 15 and an opening-degree instruction for the expansion valve 16 on the basis of the outdoor-unit sensor information determined by the sensors 11.

The micro 12 acquires the outdoor-unit sensor information determined by the sensors 11. Then, the micro 12 performs control to write the acquired outdoor-unit sensor information into the memory 14, which will be described later. Furthermore, the micro 12 controls communication of the first communication unit 13, which will be described later. In addition, the micro 12 sets and changes a state of the outdoor unit 10 on the basis of control instruction information received from the remote control 30 via the indoor unit 20.

The first communication unit 13 controls communication with the indoor unit 20 in the first communication mode on the basis of an instruction from the micro 12. For example, the first communication unit 13 receives indoor-unit sensor information, which is sensor information about the indoor unit 20, from the indoor unit 20 and provides the received indoor-unit sensor information to the micro 12.

Furthermore, the first communication unit 13 receives control instruction information from the remote control 30 via the indoor unit 20 and provides the received control instruction information to the micro 12. Additionally, the first communication unit 13 acquires outdoor-unit identification information stored in the memory 14, which will be described later, from the micro 12 and transmits this information to the indoor unit 20.

The memory 14 is a data storage unit that stores various pieces of data. The memory 14 allows the outdoor-unit sensor information determined by the sensors 11 to be written and read under the control of the micro 12. Furthermore, the memory 14 allows the indoor-unit sensor information representing, for example, a suction temperature and temperatures of the pipes in the indoor unit 20, obtained through the first communication unit 13 to be written and read under the control of the micro 12. In the following description, the "outdoor-unit sensor information" and the "indoor-unit sensor information" will be appropriately referred to collectively as "sensor information."

Furthermore, the memory 14 stores the outdoor-unit identification information, written upon manufacture of the outdoor unit 10, for identifying the outdoor unit 10. The outdoor-unit identification information includes, for example, a product model name and a serial number of the outdoor unit 10. The serial number is a number unique to the outdoor unit 10, The "memory 14" corresponds to a "first memory" in the present invention.

(Indoor Unit)

The indoor unit 20 of the air-conditioning apparatus 1 includes one or more sensors 21, a micro 22, a second communication unit 23, a third communication unit 24, and a memory 25.

The sensors 21 are arranged at different positions in and on the indoor unit 20 to determine states of targets. Specifically, the sensors 21 are, for example, temperature sensors to determine temperatures at the positions, for example, a suction temperature of air in the air-conditioned space and temperatures of the pipes. Information representing the determined temperatures at the positions in and on the indoor unit 20 is provided as indoor-unit sensor information to the micro 22. The sensors 21 are not limited to temperature sensors. For example, pressure sensors may be used to determine pressures at the positions.

The micro 22 controls the whole of the indoor nit 20, for example, controls operations of the devices included in the refrigerant circuit. Furthermore, the micro 22 acquires the indoor-unit sensor information representing the states at the positions, for example, the suction temperature and the temperatures of the pipes, determined by the sensors 21.

Then, the micro 22 performs control to write the acquired indoor-unit sensor information into the memory 25, which will be described later. Furthermore, the micro 22 controls communication of the second and third communication units 23 and 24, which will be described later.

The micro 22 sets and changes a state of the indoor unit 20 on the basis of control instruction information received from the remote control 30, which will be described later. The micro 22 transfers the received control instruction information to the outdoor unit 10 as necessary.

The second communication unit 23 controls communication with the outdoor unit 10 in the first communication mode on the basis of an instruction from the micro 22. For example, the second communication unit 23 acquires the indoor-unit sensor information determined by the sensors 21 and the control instruction information, received from the remote control 30, from the micro 22 and transmits these pieces of information to the outdoor unit 10. Furthermore, the second communication unit 23 receives the outdoor-unit identification information from the outdoor unit 10 and provides the information to the micro 22.

The third communication unit 24 controls communication with the remote control 30 in the second communication mode on the basis of an instruction from the micro 22. For example, the third communication unit 24 receives control instruction information from the remote control 30 and provides the received control instruction information to the micro 22. Furthermore, the third communication unit 24 transmits the outdoor-unit identification information, received from the outdoor unit 10 through the second communication unit 23, and indoor-unit identification information stored in the memory 25, which will be described later, and acquired from the micro 22 to the remote control 30.

The memory 25 is a data storage unit that stores various pieces of data. The memory 25 allows the indoor-unit sensor information determined by the sensors 11 to be written and read under the control of the micro 22. Furthermore, the memory 14 stores the indoor-unit identification information, written upon manufacture of the indoor unit 20, for identifying the indoor unit 20. The indoor-unit identification information includes, for example, a product model name and a serial number of the indoor unit 20. The serial number is a number unique to the indoor unit 20. The "memory 25" corresponds to a "second memory" in the present invention.

(Remote Controller)

The remote control 30 of the air-conditioning apparatus 1 includes a fourth communication unit 31, a micro 32, a memory 33, a fifth communication unit 34, a display unit 35, and an operation unit 36.

The fourth communication unit 31 controls communication with the indoor unit 20 in the second communication mode on the basis of an instruction from the micro 32. For example, the fourth communication unit 31 acquires control instruction information for controlling operations of the outdoor and indoor units 10 and 20 from the micro 32 and transmits the acquired information to the indoor unit 20. Furthermore, the fourth communication unit 31 receives the outdoor-unit identification information and the indoor-unit identification information from the indoor unit 20 and provides these pieces of information to the micro 32. In the following description, if the "outdoor-unit identification information" and the "indoor-unit identification information" are described together, these pieces of identification information will be appropriately referred to as "identification information of the air-conditioning apparatus 1."

The micro 32 controls the whole of the remote control 30 in response to a user operation on the operation unit 36, which will be described later. For example, the micro 32 generates control instruction information for controlling the operations of the outdoor and indoor units 10 and 20 on the basis of an operation signal obtained by a user operation.

The micro 32 performs control to write the acquired identification information of the air-conditioning apparatus 1 into the memory 33, which will be described later. Furthermore, the micro 22 controls communication of the fourth communication unit 31 and the fifth communication unit 34, which will be described later. When the micro 32 acquires the identification information of the air-conditioning apparatus 1, the micro 32 controls the fifth communication unit 34 to transmit the identification information to the information terminal 40.

The memory 33 is a data storage unit that stores various pieces of data. The memory 33 allows the identification information of the air-conditioning apparatus 1 to be written and read under the control of the micro 32. The "memory 33" corresponds to a "third memory" in the present invention.

The fifth communication unit 34 controls communication with the information terminal 40 in the third communication mode on the basis of an instruction from the micro 32. For example, the fifth communication unit 34 transmits the identification information of the air-conditioning apparatus 1, read from the memory 33, to the information terminal 40 under the control of the micro 32. The information terminal 40 receives the identification information of the air-conditioning apparatus 1 from the remote control 30, transmits the information to a server 50 in the cloud connected via a network 5, such as the Internet, and stores the information to the server 50.

The display unit 35 is made of, for example, a liquid crystal display (LCD) or an organic light-emitting diode (OLED) display based on electroluminescence. The display unit 35 is capable of displaying the product model names and the serial numbers of the outdoor and indoor units 10 and 20 based on the identification information of the air-conditioning apparatus 1. Other examples of the display unit 35 include a touch panel display including an LCD or an OLED display and a touch panel with touch sensors disposed on the LCD or the OLED display.

The operation unit 36 includes various buttons or keys used to operate the air-conditioning apparatus 1, and outputs an operation signal in response to an operation assigned to each button or key. If the display unit 35 is a touch panel display as described above, the various buttons or keys may be displayed as software buttons or software keys on the display unit 35.

[Operation of Air-Conditioning System]

An operation of the air-conditioning system 100 with the above-described configuration will be described below. In Embodiment 1, the identification information of the air-conditioning apparatus 1 is stored to the remote control 30, the information terminal 40, and the server 50 when the air-conditioning apparatus 1 is operated as trial upon installation.

(Storage of Identification Information to Remote Control)

When the air-conditioning apparatus 1 is to be operated as trial in response to an operation on the operation unit 36 of the remote control 30 upon installation of the air-conditioning apparatus 1, the micro 32 of the remote control 30 generates control instruction information for trial operation on the basis of an operation signal from the operation unit 36. An instruction for trial operation may be given by, for example, operating the information terminal 40.

The micro 32 provides the generated control instruction information to the fourth communication unit 31. The fourth communication unit 31 transmits the control instruction information to the indoor unit 20, connected with the second connection line 3, by using the second communication mode.

In the indoor unit 20, the third communication unit 24 receives the control instruction information transmitted from the remote control 30 and provides the received control instruction information to the micro 22. The micro 22 acquires the control instruction information and provides the information to the second communication unit 23. The second communication unit 23 transmits the control instruction information to the outdoor unit 10, connected with the first connection line 2, by using the first communication mode.

Furthermore, when the micro 22 determines that the air-conditioning apparatus 1 is to be operated as trial on the basis of the acquired control instruction information, the micro 22 reads the indoor-unit identification information from the memory 25 and provides the information to the third communication unit 24. The third communication unit 24 transmits the indoor-unit identification information to the remote control 30, connected with the second connection line 3, by using the second communication mode.

In the outdoor unit 10, the first communication unit 13 receives the control instruction information transmitted from the indoor unit 20 and provides the received control instruction information to the micro 12. When the micro 12 determines that the air-conditioning apparatus 1 is to be operated as trial on the basis of the acquired control instruction information, the micro 12 reads the outdoor-unit identification information from the memory 14 and provides the information to the first communication unit 13. The first communication unit 13 transmits the outdoor-unit identification information to the indoor unit 20, connected with the first connection line 2, by using the first communication mode.

In the indoor unit 20, the second communication unit 23 receives the outdoor-unit identification information transmitted from the outdoor unit 10 and provides the received outdoor-unit identification information to the micro 22. The micro 22 acquires the outdoor-unit identification information and provides the outdoor-unit identification information to the third communication unit 24. The third communication unit 24 transmits the outdoor-unit identification information to the remote control 30, connected with the second connection line 3, by using the second communication mode.

In the remote control 30, the fourth communication unit 31 receives the outdoor-unit identification information and the indoor-unit identification information individually transmitted from the indoor unit 20 and provides the received pieces of identification information to the micro 32. The micro 32 acquires the identification information of the air-conditioning apparatus 1 and writes and stores the acquired identification information into the memory 33.

As described above, the identification information of the air-conditioning apparatus 1 stored in the above-described manner includes the product model names and the serial numbers of the outdoor and indoor units 10 and 20. For example, when an abnormal condition, such as a malfunction and a failure, occurs in the air-conditioning apparatus 1, the micro 32 of the remote control 30 reads the identification information of the air-conditioning apparatus 1 from the memory 33. Then, the micro 32 causes the display unit 35 to display the product model names and the serial numbers of the outdoor and indoor units 10 and 20 included in the read identification information of the air-conditioning apparatus 1 together with an error code, which is error information representing details of the abnormal condition.

In the above-described example, the outdoor-unit identification information and the indoor-unit identification information are individually transmitted to the remote control 30. The transmission of the information is not limited to this example. For example, when the indoor unit 20 receives the outdoor-unit identification information from the outdoor unit 10, the indoor unit 20 may transmit the indoor-unit identification information together with the outdoor-unit identification information to the remote control.

(Storage of Identification Information to Information Terminal)

When the information terminal 40 is operated under conditions in which the identification information of the air-conditioning apparatus 1 is stored in the memory 33 of the remote control 30, the micro 32 reads out the identification information of the air-conditioning apparatus 1 stored in the memory 33 and provides the read identification information to the fifth communication unit 34. The fifth communication unit 34 transmits the identification information of the air-conditioning apparatus 1 to the information terminal 40, connected with the third connection line 4, by using the third communication mode. The information terminal 40 receives the identification information of the air-conditioning apparatus 1 transmitted from the remote control 30 and stores the identification information into, for example, a memory (not illustrated).

(Storage of Identification Information to Server)

When the information terminal 40 stores the received identification information of the air-conditioning apparatus 1, the information terminal 40 transmits the stored identification information together with information representing a result of trial operation to the server 50 on the Internet connected via the network 5. The server 50 receives the identification information of the air-conditioning apparatus 1 and the information representing the result of trial operation transmitted from the information terminal 40 and stores the identification information. The identification information of the air-conditioning apparatus 1 stored on the server 50 as described above and the information representing the result of trial operation can be remotely determined by using, for example, a terminal allowed to have access to the server 50.

Although the configuration of the air-conditioning apparatus 1 including one outdoor unit 10 and one indoor unit 20 has been described as an example, the configuration is not limited to this example. For example, either the number of outdoor units 10 or the number of indoor units 20 may be plural. Alternatively, both the number of outdoor units 10 and the number of indoor units 20 may be plural. In other words, the number of outdoor units 10 and the number of indoor units 20 can be appropriately determined depending on circumstances in which the air-conditioning apparatus 1 is installed.

Figure 2:
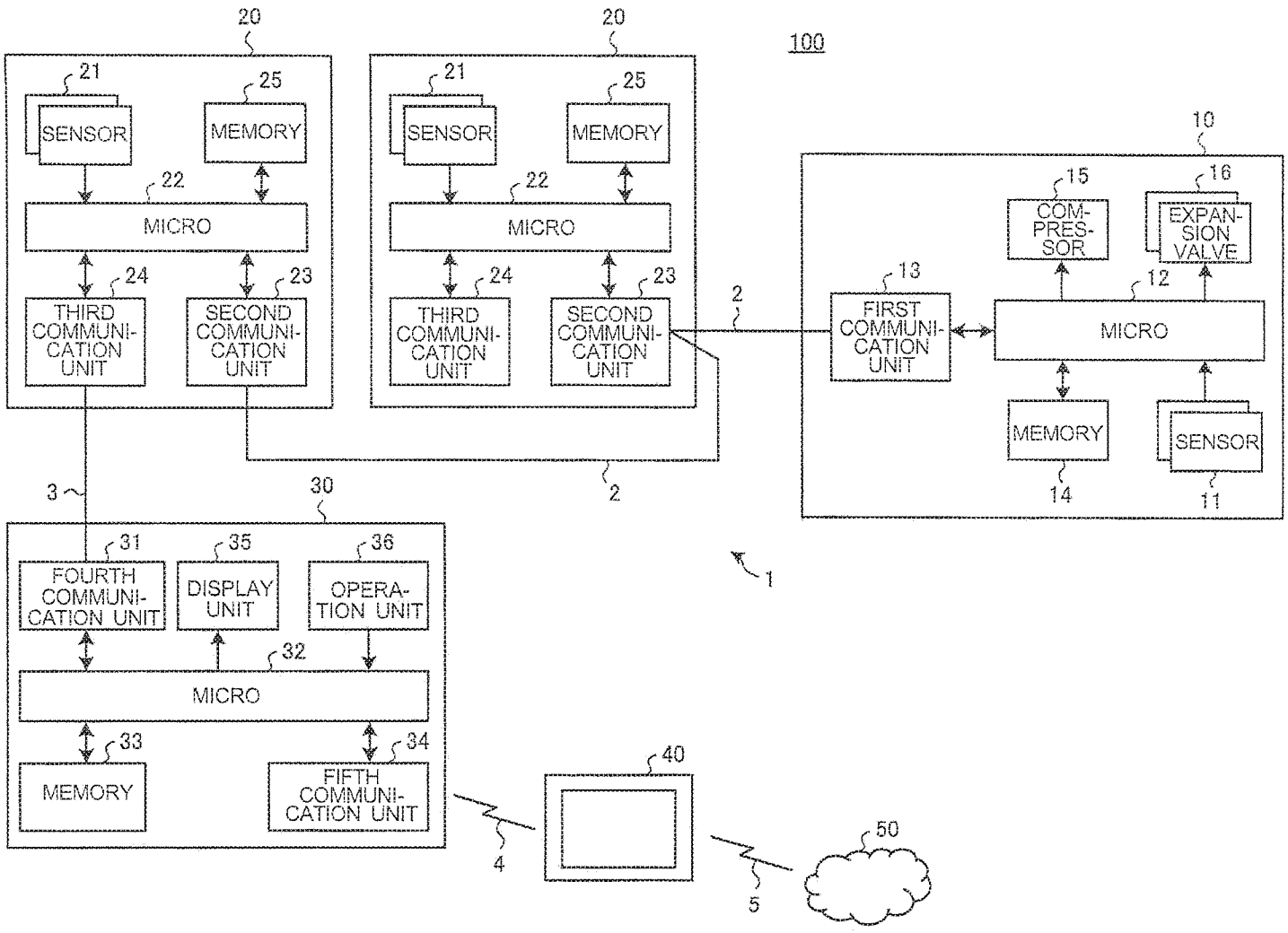
FIG. 2 is a block diagram illustrating another exemplary configuration of the air-conditioning system according to Embodiment 1.
Figure 3:
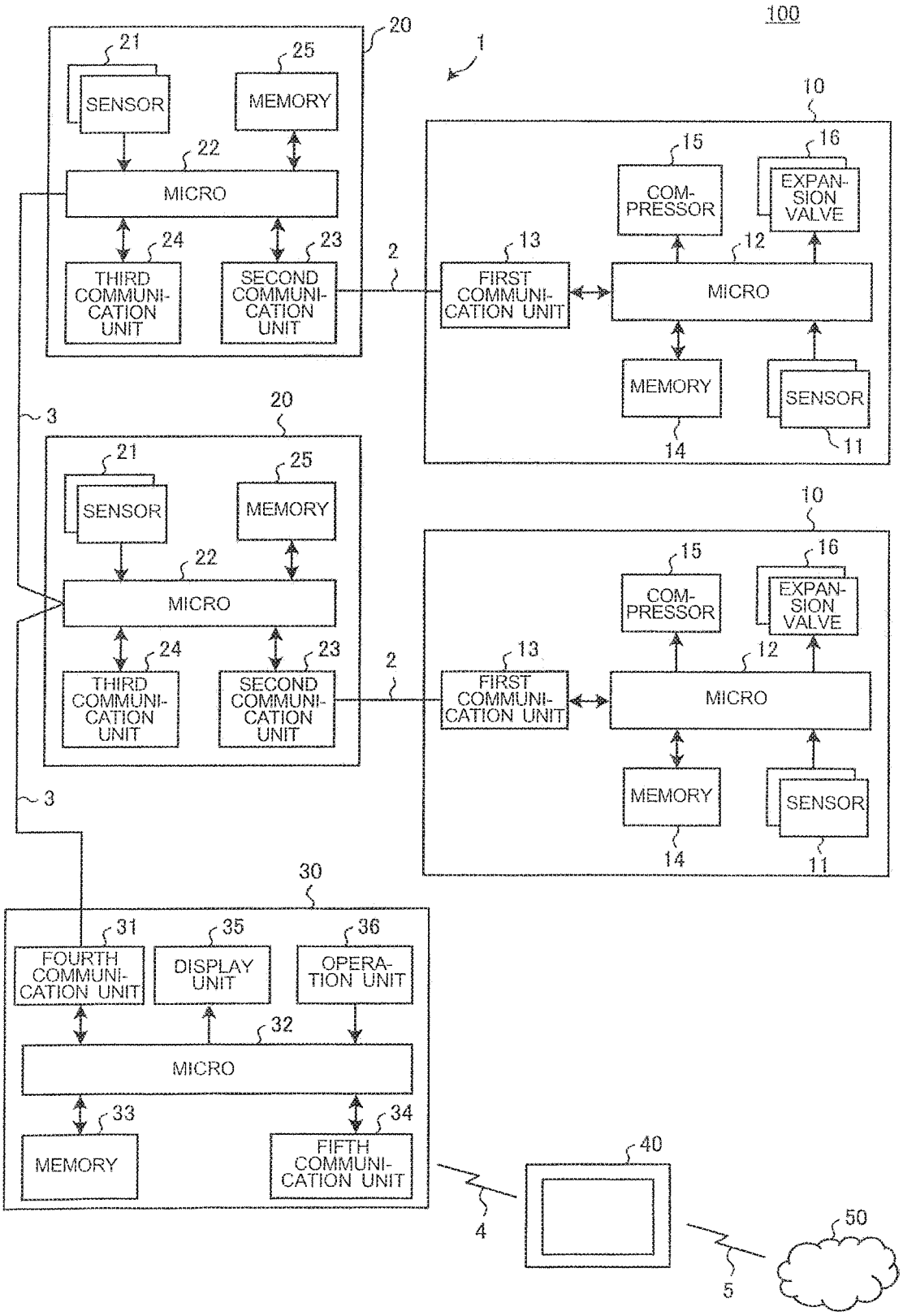
FIG. 3 is a block diagram illustrating another exemplary configuration of the air-conditioning system according to Embodiment 1.

FIGS. 2 and 3 are block diagrams illustrating other exemplary configurations of the air-conditioning system 100 according to Embodiment 1. FIG. 2 illustrates an exemplary configuration in which a plurality of indoor units 20 are connected to one outdoor unit 10. FIG. 3 illustrates an exemplary configuration in which a plurality of outdoor units 10 are each connected to the corresponding one of a plurality of indoor units 20. If at least either the number of outdoor units 10 or the number of indoor units 20 is plural in the air-conditioning apparatus 1, the remote control 30 can store outdoor-unit identification information and indoor-unit identification information of all of the outdoor and indoor units controlled by the remote control 30. The information terminal 40 and the server 50 can store the identification information of the air-conditioning apparatus 1, stored in the remote control 30, in a manner similar to that in the example of FIG. 1.

As described above, the air-conditioning system 100 according to Embodiment 1 includes the air-conditioning apparatus 1 including the outdoor unit 10 and the indoor unit 20, which include the devices and the pipes included in the refrigerant circuit, and further including the remote control 30 connected to the indoor unit 20. The outdoor unit 10 includes the memory 14 storing the outdoor-unit identification information including the product model name and the serial number of the outdoor unit 10. The indoor unit 20 includes the memory 25 storing the indoor-unit identification information including the product model name and the serial number of the indoor unit 20. The remote control 30 includes the memory 33 to store the outdoor-unit identification information and the indoor-unit identification information and the display unit 35 to display error information representing details of an abnormal condition when the abnormal condition occurs in the air-conditioning apparatus 1. The remote control 30 obtains the outdoor-unit identification information from the outdoor unit 10, further obtains the indoor-unit identification information from the indoor unit 20, and then stores the obtained outdoor-unit identification information and indoor-unit identification information into the memory 33. When an abnormal condition occurs in the air-conditioning apparatus 1, the remote control 30 causes the display unit 35 to display the stored outdoor-unit identification information and indoor-unit identification information together with error information.

In Embodiment 1, as described above, the outdoor-unit identification information and the indoor-unit identification information are stored in the remote control 30. When an abnormal condition occurs, the product model names and the serial numbers included in the identification information are displayed on the remote control 30, so that the user can readily determine, for example, a model or type of the air-conditioning apparatus 1. Consequently, the user can inform a maintenance operator of, for example, the model of the apparatus, when the user contacts the contractor. Thus, rapid check and repair, for example, are allowed.

The air-conditioning system 100 further includes the information terminal 40 connected to the remote control 30 and communicating with the remote control 30 and the server 50 connected to the information terminal 40 via the network 5 and communicating with the information terminal 40. The information terminal 40 obtains the identification information of the air-conditioning apparatus 1 from the remote control 30 and stores the obtained identification information to the server 50. Consequently, for example, the model can be determined remotely by using, for example, a terminal allowed to have access to the server 50.

Embodiment 2

An air-conditioning system according to Embodiment 2 will be described below. The air-conditioning system 100 according to Embodiment 2 differs from the above-described system according to Embodiment 1 in that a maintenance-operators contact is stored to the remote control 30. In the following description, the same components as those in Embodiment 1 are designated by the same reference signs and the detailed description of the components is omitted.

The air-conditioning system 100 according to Embodiment 2 has the same configuration as that in Embodiment 1, and the description and illustration of the system is omitted herein. In Embodiment 2, the information terminal 40 has contact information previously set and representing a maintenance-operators contact, such as an address, a shop name, and a telephone number of a maintenance operator. When the information terminal 40 is connected to the remote control 30 in the third communication mode, or alternatively, when the information terminal 40 is connected to the remote control 30 and an instruction for trial operation is given to the air-conditioning apparatus 1 by using the information terminal 40, the information terminal 40 transmits the set contact information to the remote control 30.

In the remote control 30, the fifth communication unit 34 receives the contact information transmitted from the information terminal 40 and provides the received contact information to the micro 32. The micro 32 acquires the contact information and then writes and stores the acquired contact information into the memory 33.

As described in Embodiment 1, for example, when an abnormal condition occurs in the air-conditioning apparatus 1, the remote control 30 causes the display unit 35 to display the product model names and the serial numbers of the outdoor and indoor units 10 and 20, included in the identification information of the air-conditioning apparatus 1, together with an error code. In Embodiment 2, the maintenance-operators contact is displayed in addition to these pieces of information.

Specifically, for example, when an abnormal condition, such as a malfunction and a failure, occurs in the air-conditioning apparatus 1, the micro 32 of the remote control 30 reads the identification information of the air-conditioning apparatus 1 and the contact information of the maintenance operator from the memory 33. The micro 32 causes the display unit 35 to display the product model names and the serial numbers of the outdoor and indoor units 10 and 20 included in the read identification information and the maintenance-operator's contact included in the contact information together with an error code.

In Embodiment 2, as described above, the information terminal 40 has the contact information previously set and representing the maintenance-operator's contact. When the information terminal 40 is connected to the remote control 30, the information terminal 40 transmits the contact information to the remote control 30. The remote control 30 receives the contact information from the information terminal 40 and stores the received contact information into the memory 33.

As described above, the remote control 30 stores the contact information of the maintenance operator received from the information terminal 40. This configuration facilitates storage of the contact information as compared with a case in which the contact information of the maintenance operator is written and stored by using, for example, the operation unit 36 of the remote control 30. In other words, the contact information can be stored to the remote control 30 without any operation on the remote control 30.

When an abnormal condition occurs in the air-conditioning apparatus 1, the remote control 30 is caused to display the maintenance-operator's contact. Thus, the user can readily determine the maintenance-operator's contact and contact the maintenance operator.

Embodiment 3

An air-conditioning system according to Embodiment 3 will be described below. The air-conditioning system 100 according to Embodiment 3 differs from the above-described systems in Embodiments 1 and 2 in that the identification information of the air-conditioning apparatus 1 is stored in association with information about an installation location, in which the air-conditioning apparatus 1 is installed, when the identification information is stored to the server 50. In the following description, the same components as those in Embodiments 1 and 2 are designated by the same reference signs and the detailed description of the components is omitted.

The air-conditioning system 100 according to Embodiment 3 has the same configuration as that in Embodiment 1, and the description and illustration of the system is omitted herein. In Embodiment 3, installation location information, which is information about an installation location, representing, for example, an address of the installation location and a name associated with the location, is previously set to the information terminal 40 in response to a user input operation. When the information terminal 40 receives the identification information of the air-conditioning apparatus 1 in a manner similar to that in Embodiment 1 described above, the information terminal 40 associates the received identification information with the previously set installation location information.

The information terminal 40 transmits the identification information and the installation location information associated with each other to the server 50 on the Internet connected via the network 5. The server 50 receives the identification information of the air-conditioning apparatus 1 and the installation location information transmitted from the information terminal 40, and stores these pieces of information.

(Modification)

A modification of Embodiment 3 will be described below. In this modification, position information based on a global positioning system (GPS) is used to set installation location information. For example, the information terminal 40 may have a function of obtaining GPS-based position information. In this case, an installation location in which the air-conditioning apparatus 1 is installed can be set on the basis of position information obtained by using this position information obtaining function.

Figure 4:
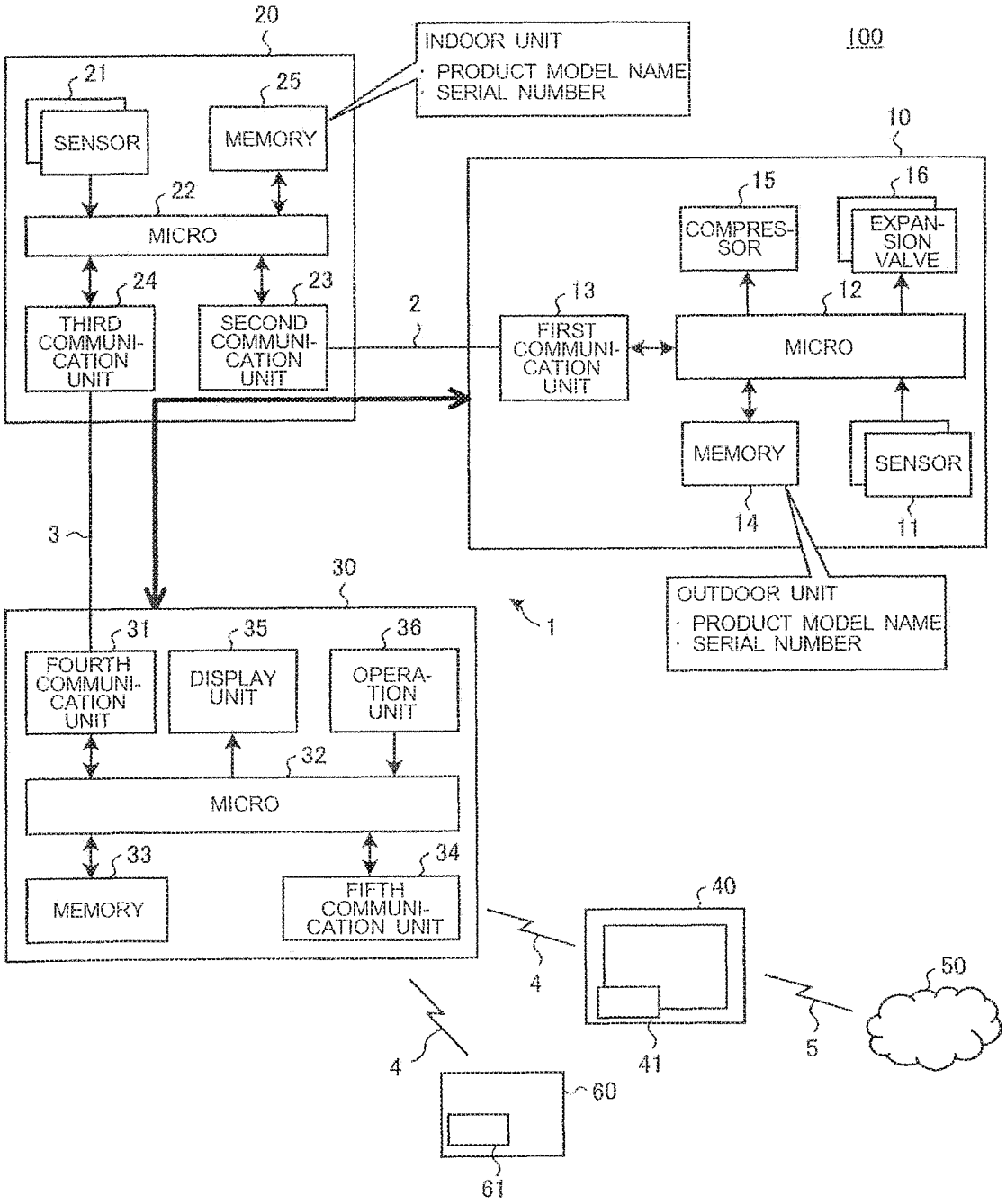
FIG. 4 is a block diagram illustrating an exemplary configuration of an air-conditioning system according to Embodiment 3.

FIG. 4 is a block diagram illustrating an exemplary configuration of the air-conditioning system 100 according to Embodiment 3, In the following description, the same components as those in Embodiments 1 and 2 described above are designated by the same reference signs and the description of these components is omitted.

In the exemplary configuration of FIG. 4, the information terminal 40 includes a position information obtaining unit 41. The position information obtaining unit 41 receives a GPS signal from the GPS. The position information obtaining unit 41 obtains position information representing a latitude and a longitude included in the received GPS signal, and determines the current position of the information terminal 40.

The exemplary configuration includes a device 60, such as a clock, which is connected to the remote control 30 with the third connection line 4 and is capable of communicating with the remote control 30 by using the third communication mode. The device 60 includes a position information obtaining unit 61 that determines the position of the device 60 in the same manner as the position information obtaining unit 41 of the information terminal 40.

In the modification of Embodiment 3, the information terminal 40 obtains, as installation location information, the position information obtained through the position information obtaining unit 41. Furthermore, when the information terminal 40 receives the identification information of the air-conditioning apparatus 1 in the same manner as in Embodiment 1 described above, the information terminal 40 associates the received identification information with the installation location information based on the obtained position information.

The information terminal 40 transmits the identification information and the installation location information associated with each other to the server 50 on the Internet connected via the network 5. The server 50 receives the identification information of the air-conditioning apparatus 1 and the installation location information transmitted from the information terminal 40, and stores these pieces of information.

In the modification of Embodiment 3, instead of using the position of the information terminal 40 as an installation location in which the air-conditioning apparatus 1 is installed, for example, the position of the device 60, such as a clock, disposed in proximity to the air-conditioning apparatus 1 may be used as an installation location. In such a case, the remote control 30 is first connected to the device 60 by using the third communication mode.

The device 60 obtains position information through the position information obtaining unit 61 and transmits the obtained position information to the information terminal 40 via the remote control 30. The information terminal 40 receives the position information from the device 60 and sets the position information as installation location information. Then, the information terminal 40 associates the identification information received from the remote control 30 with the installation location information and transmits these pieces of information to the server 50 as in Embodiment 3.

If the information terminal 40 can be directly connected to the device 60, the position information obtained by the device 60 can be received directly by the information terminal 40 without being transferred via the remote control 30. For example, if position information can be obtained by, for example, the outdoor unit 10, the indoor unit 20, or the remote control 30 of the air-conditioning apparatus 1, the position information may be transmitted, as installation location information, together with the identification information to the information terminal 40.

Furthermore, the GPS can be used only within a range in which satellite radio waves reach. For example, a GPS signal may not be received in an indoor space. In such a case, the last position information obtained by a device capable of receiving a GPS signal, for example, the information terminal 40, may be corrected by using, for example, a gyroscopic sensor, and the corrected position information may be used as installation location information.

In Embodiment 3, as described, the information terminal 40 has the installation location information previously set about the installation location including the position of the air-conditioning apparatus 1. When the information terminal 40 receives the outdoor-unit identification information and the indoor-unit identification information, the information terminal 40 associates the outdoor-unit identification information and the indoor-unit identification information with the installation location information. Then, the information terminal 40 transmits the outdoor-unit identification information, the indoor-unit identification information, and the installation location information associated with each other to the server 50.

As the outdoor-unit identification information, the indoor-unit identification information, and the installation location information associated with each other are stored on the server 50 as described above, the location in which the air-conditioning apparatus 1 is installed can be remotely determined. Consequently, when an abnormal condition occurs in the air-conditioning apparatus 1, a maintenance operator can determine the model of the air-conditioning apparatus 1 and the installation location of the apparatus, and can rapidly deal with the abnormal condition, for example, check or repair the air-conditioning apparatus 1.

Although Embodiments 1 to 3 of the present invention and the modification of Embodiment 3 have been described above, the present invention is not limited to Embodiments 1 to 3 of the present invention and the modification of Embodiment 3 described above. Various modifications and applications of Embodiments 1 to 3 are possible without departing from the spirit and scope of the present invention. For example, the examples illustrated in Embodiments 1 to 3 and the modification of Embodiment 3 can be combined with each other.

REFERENCE SIGNS LIST

1 air-conditioning apparatus 2 first connection line 3 second connection line 4 third connection line 5 network 10 outdoor unit 11 sensor 12 microcomputer 13 first communication unit 14 memory 15 compressor 16 expansion valve 20 indoor unit 21 sensor 22 microcomputer 23 second communication unit 24 third communication unit 25 memory 30 remote controller 31 fourth communication unit 32 micro 33 memory 34 fifth communication unit 35 display unit 36 operation unit 40 information terminal position information obtaining unit 50 server 60 device 61 position information obtaining unit 100 air-conditioning system

The invention claimed is:

1. An air-conditioning system, comprising:

an air-conditioning apparatus including an outdoor unit, an indoor unit, and a remote controller connected to the indoor unit, the outdoor unit and the indoor unit including devices and pipes included in a refrigerant circuit;

an information terminal configured to connect to the remote controller and to communicate with the remote controller; and a server connected to the information terminal via a network and configured to communicate with the information terminal, a first memory contained within the outdoor unit and storing outdoor-unit identification information including a product model name and a serial number of the outdoor unit which was written in the first memory prior to operation of the air-conditioning system, a second memory contained within the indoor unit and storing indoor-unit identification information including a product model name and a serial number of the indoor unit which was written in the second memory prior to operation of the air-conditioning system, and a third memory contained within the remote controller and configured to store the outdoor-unit identification information and the indoor-unit identification information, wherein the remote controller includes a display unit configured to display error information representing details of an abnormal condition when the abnormal condition occurs in the air-conditioning apparatus and a microcomputer, and during operation of the air-conditioning system, the microcomputer of the remote controller is configured:

to obtain the outdoor-unit identification information from the outdoor unit and to obtain the indoor-unit identification information from the indoor unit, to store the obtained outdoor-unit identification information and indoor-unit identification information into the third memory, and to display on the display unit the stored outdoor-unit identification information and indoor-unit identification information together with the error information when an abnormal condition occurs in the air-conditioning apparatus, and wherein the information terminal is configured:

to obtain the outdoor-unit identification information and the indoor-unit identification information from the remote controller when the information terminal is connected to the remote controller, and to transmit the obtained outdoor-unit identification information and indoor-unit identification information to the server.

2. The air-conditioning system of claim 1, wherein the information terminal has contact information previously set and representing a maintenance-operator's contact and is configured to transmit the contact information to the remote controller when the information terminal is connected to the remote controller, and wherein the remote controller is configured to store the contact information obtained from the information terminal into the third memory.

3. The air-conditioning system of claim 2, wherein when an the abnormal condition occurs in the air-conditioning apparatus, the remote controller is configured to cause the display unit to display the contact information together with the error information.

4. The air-conditioning system of claim 1, wherein the information terminal has installation location information previously set about an installation location including a position of the air-conditioning apparatus, wherein when the information terminal receives the outdoor-unit identification information and the indoor-unit identification information, the information terminal is configured to associate the outdoor-unit identification information and the indoor-unit identification information with the installation location information, and wherein the information terminal is configured to transmit the outdoor-unit identification information, the indoor-unit identification information, and the installation location information associated with each other to the server.

5. The air-conditioning system of claim 4, wherein the information terminal is configured to be operated to set the installation location information.

6. The air-conditioning system of claim 4, wherein the information terminal includes a position information obtaining unit which obtains position information representing a current position, and wherein the information terminal is configured to set the position information obtained by the position information obtaining unit of the information terminal as the installation location information.

* * * * *